US012729416B2

(12) United States Patent
Luo et al.

(10) Patent No.: US 12,729,416 B2
(45) Date of Patent: Sep. 8, 2026

(54) ALUMINUM ALLOYS AND METHODS OF MAKING AND USE THEREOF

(71) Applicant: Ohio State Innovation Foundation, Columbus, OH (US)

(72) Inventors: Aihua Luo, Westerville, OH (US); Emre Cinkilic, Columbus, OH (US); Michael Moodispaw, Powell, OH (US)

(73) Assignee: OHIO STATE INNOVATION FOUNDATION, Columbus, OH (US)

( * ) Notice: Subject to any disclaimer, the term of this patent is extended or adjusted under 35 U.S.C. 154(b) by 405 days.

(21) Appl. No.: 18/278,916

(22) PCT Filed: Feb. 25, 2022

(86) PCT No.: PCT/US2022/017815

§ 371 (c)(1),
(2) Date: Aug. 25, 2023

(87) PCT Pub. No.: WO2022/182937

PCT Pub. Date: Sep. 1, 2022

(65) Prior Publication Data

US 2024/0060158 A1 Feb. 22, 2024

Related U.S. Application Data

(60) Provisional application No. 63/154,196, filed on Feb. 26, 2021.

(51) Int. Cl.
*C22C 21/00* (2006.01)

(52) U.S. Cl.
CPC ..... *C22C 21/00* (2013.01)

(58) Field of Classification Search
CPC ..... C22C 21/00; C22C 1/026; C22C 1/03
See application file for complete search history.

(56) References Cited

U.S. PATENT DOCUMENTS

| | | | | |
|---|---|---|---|---|
| 3,278,300 | A * | 10/1966 | Koike | C22C 21/00 420/550 |
| 3,964,935 | A | 6/1976 | Wilks | |
| 5,306,363 | A | 4/1994 | Masumoto et al. | |
| 6,306,342 | B2 | 10/2001 | Koch et al. | |
| 8,337,644 | B2 | 12/2012 | Trenda et al. | |
| 9,963,770 | B2 | 5/2018 | Rios et al. | |
| 10,584,403 | B2 | 3/2020 | Rios et al. | |
| 2018/0237893 | A1 | 8/2018 | Rios et al. | |
| 2019/0085431 | A1 | 3/2019 | Rios et al. | |

(Continued)

FOREIGN PATENT DOCUMENTS

| | | | | |
|---|---|---|---|---|
| JP | H01272739 | A | 10/1989 | |
| WO | WO-2018044047 | A1 * | 3/2018 | C22C 21/00 |

(Continued)

OTHER PUBLICATIONS

English Abstract and English Machine Translation of Kim et al. (WO 2018/044047 A1) (Mar. 8, 2018).*

(Continued)

*Primary Examiner* — Jessee R Roe
(74) *Attorney, Agent, or Firm* — Meunier Carlin & Curfman LLC

(57) ABSTRACT

Disclosed herein are aluminum alloys and methods of making and use thereof.

17 Claims, 7 Drawing Sheets

(56) References Cited

U.S. PATENT DOCUMENTS

2022/0098706 A1 3/2022 Luo et al.

FOREIGN PATENT DOCUMENTS

WO 2018/119283 A1 6/2018
WO 2020180441 A1 9/2020

OTHER PUBLICATIONS

International Searching Authority (ISA/US). International Search Report and Written Opinion. PCT Application No. PCT/US2022/017815. Issued on May 16, 2022. 12 pages.
European Patent Office. Extended search report. Issued in EP Application No. 22760451.9. Jan. 17, 2025. 11 pages.
Ayer et al. (1988). Microstructural characterization of the dispersed phases in Al—Ce—Fe system. Metallurgical Transactions A, 19, 1645-1656.
Sims ZC et al. High performance aluminum-cerium alloys for high-temperature applications, Mater. Horiz. 2017, 4, 1070-1078.
Sims ZC et al. Cerium-Based, Intermetallic-Strengthened Aluminum Casting Alloy: High-Volume Co-product Development, JOM, 68(7), 1940-1947,2016.
Stromme ET et al. Ageless Aluminum-Cerium-Based Alloys in High-Volume Die Casting for Improved Energy Efficiency, JOM, 2018, 70(6), 866-871.
Weiss D et al. Casting Characteristics of High Cerium Content Aluminum Alloys, Light Metals, 2017, 205-211.

* cited by examiner

ALUMINUM ALLOYS AND METHODS OF MAKING AND USE THEREOF

CROSS-REFERENCE TO RELATED APPLICATIONS

This application is a U.S. National Stage application filed under 35 U.S.C. § 371 of PCT/US2022/017815 filed Feb. 25, 2022, which claims the benefit of priority to U.S. Provisional Application No. 63/154,196 filed Feb. 26, 2021, each of which is hereby incorporated herein by reference in its entirety.

STATEMENT OF GOVERNMENT SUPPORT

This invention was made with government support under DE-EE0007897 awarded by the Department of Energy. The government has certain rights in the invention.

BACKGROUND

Although the world will need to increase primary production to keep up with demand, the adoption of secondary aluminum is increasing worldwide due to a variety of factors. However, iron (Fe) is a major impurity element in primary and secondary (scrap) aluminum alloys, and is difficult to remove during melting and casting. Strategies for controlling the formation of Al—Fe based intermetallics via alloying are needed to improve the mechanical properties of aluminum alloy products. The compositions, methods, and systems discussed herein addresses these and other needs.

SUMMARY

In accordance with the purposes of the disclosed compositions, methods, and systems as embodied and broadly described herein, the disclosed subject matter relates to aluminum alloys and methods of making and use thereof.

For example, disclosed herein are aluminum alloys comprising from 0.3 to 1.5 wt % Fe; from 0.2 to 16 wt % Ce; from 0 to 2% Si; and the balance comprising Al and optionally additional components; wherein the ratio of Ce to Fe is 1.2 or more.

In some examples, the aluminum alloy comprises a ternary Al—Ce—Fe phase. In some examples, the aluminum alloy comprises a $Al_{10}FeCe_2$ phase. In some examples, the aluminum alloy comprises a $Al_{10}FeCe_2$ phase, which neutralizes the detrimental effect of Fe on the mechanical properties of the aluminum alloy.

In some examples, the ratio of Ce to Fe being 1.2 or more suppresses formation of a $Al_{13}Fe_4$ phase. In some examples, the ratio of Ce to Fe being 1.2 or more suppresses formation of $\theta$-$Al_{13}Fe_4$ phase.

In some examples, the aluminum alloy is substantially free of a $Al_{13}Fe_4$ phase.

In some examples, the aluminum alloy comprises from 0.3 to 1 wt % Fe. In some examples, the aluminum alloy comprises 0.5 wt % Fe.

In some examples, the aluminum alloy comprises 0.2 to 9 wt % Ce. In some examples, the aluminum alloy comprises 0.2 to 2.5 wt % Ce. In some examples, the aluminum alloy comprises 0.2 to 1.5 wt % Ce. In some examples, the aluminum alloy comprises 1 wt % Ce.

In some examples, the aluminum alloy comprises from 0 to 0.5 wt % Si. In some examples, the aluminum alloy is substantially free of Si.

In some examples, the aluminum alloy comprises from 0.3 to 1.5 wt % Fe; from 0.2 to 9 wt % Ce, from 0 to 2% Si; and the balance comprising Al and optionally additional components. In some examples, the aluminum alloy comprises from 0.3 to 1 wt % Fe; from 0.2 to 2.5 wt % Ce; from 0 to 0.5% Si; and the balance comprising Al and optionally additional components. In some examples, the aluminum alloy comprises 0.3 to 1 wt % Fe, 0.2 to 1.5 wt % Ce, and 0 to 0.5 wt % Si, and the balance comprising Al and optionally additional components.

In some examples, the AlCeSi phase is substantially absent from the aluminum alloy.

In some examples, the aluminum alloy has an improved mechanical property (e.g., yield strength, tensile strength, elongation at failure, etc.) relative to a corresponding aluminum alloy in the absence of Ce, with a Ce/Fe ratio less than 1.2, with greater than 2 wt % Si, or a combination thereof.

In some examples, the aluminum alloy further comprises Mn, Mg, Cu, Zn, or a combination thereof.

In some examples, the aluminum alloy further comprises from 0 to 1 wt % of one or more additional components.

In some examples, the aluminum alloy comprises from 0.3 to 1.5 wt % Fe; from 0.2 to 16 wt % Ce; from 0 to 2% Si; from 0 to 1 wt % Mn; from 0 to 1 wt % Mg; from 0 to 1 wt % Cu; from 0 to 1 wt % Zn; and the balance comprising Al. In some examples, the aluminum alloy comprises from 0.3 to 1.5 wt % Fe; from 0.2 to 9 wt % Ce; from 0 to 2% Si; from 0 to 1 wt % Mn; from 0 to 1 wt % Mg; from 0 to 1 wt % Cu, from 0 to 1 wt % Zn; and the balance comprising Al.

In some examples, the aluminum alloy has a yield strength of from 55 MPa to 120 MPa. In some examples, the aluminum alloy has an ultimate tensile strength of from 175 MPa to 250 MPa. In some examples, the aluminum alloy has an elongation to failure of from 4% to 12%.

Also disclosed herein are objects comprising any of the aluminum alloys disclosed herein.

Also disclosed herein are articles of manufacture comprising any of the aluminum alloys disclosed herein.

Also disclosed herein are methods of use of any of the aluminum alloys disclosed herein.

Also disclosed herein are methods of making any of the aluminum alloys disclosed herein. For example, also disclosed herein are methods of making any of the aluminum alloys disclosed herein, the methods comprising: heating a precursor aluminum alloy to a first temperature to melt the precursor aluminum alloy, thereby forming a molten precursor aluminum alloy; and adding Ce to the molten precursor aluminum alloy; thereby forming the aluminum alloy. In some examples, the addition of Ce controls the formation of Al—Fe based intermetallic phases. In some examples, the addition of Ce neutralizes the detrimental effects of Fe on the mechanical properties of the aluminum alloy. In some examples, the precursor aluminum alloy comprises a secondary aluminum alloy (e.g., scrap or recycled aluminum alloy).

Additional advantages of the disclosed compositions, systems, and methods will be set forth in part in the description which follows, and in part will be obvious from the description. The advantages of the disclosed compositions, systems, and methods will be realized and attained by means of the elements and combinations particularly pointed out in the appended claims. It is to be understood that both the foregoing general description and the following detailed description are exemplary and explanatory only and are not restrictive of the disclosed systems and methods, as claimed.

The details of one or more embodiments of the invention are set forth in the accompanying drawings and the description below. Other features, objects, and advantages of the invention will be apparent from the description and drawings, and from the claims.

BRIEF DESCRIPTION OF THE FIGURES

The accompanying figures, which are incorporated in and constitute a part of this specification, illustrate several aspects of the disclosure, and together with the description, serve to explain the principles of the disclosure.

DETAILED DESCRIPTION

Figure 1A:
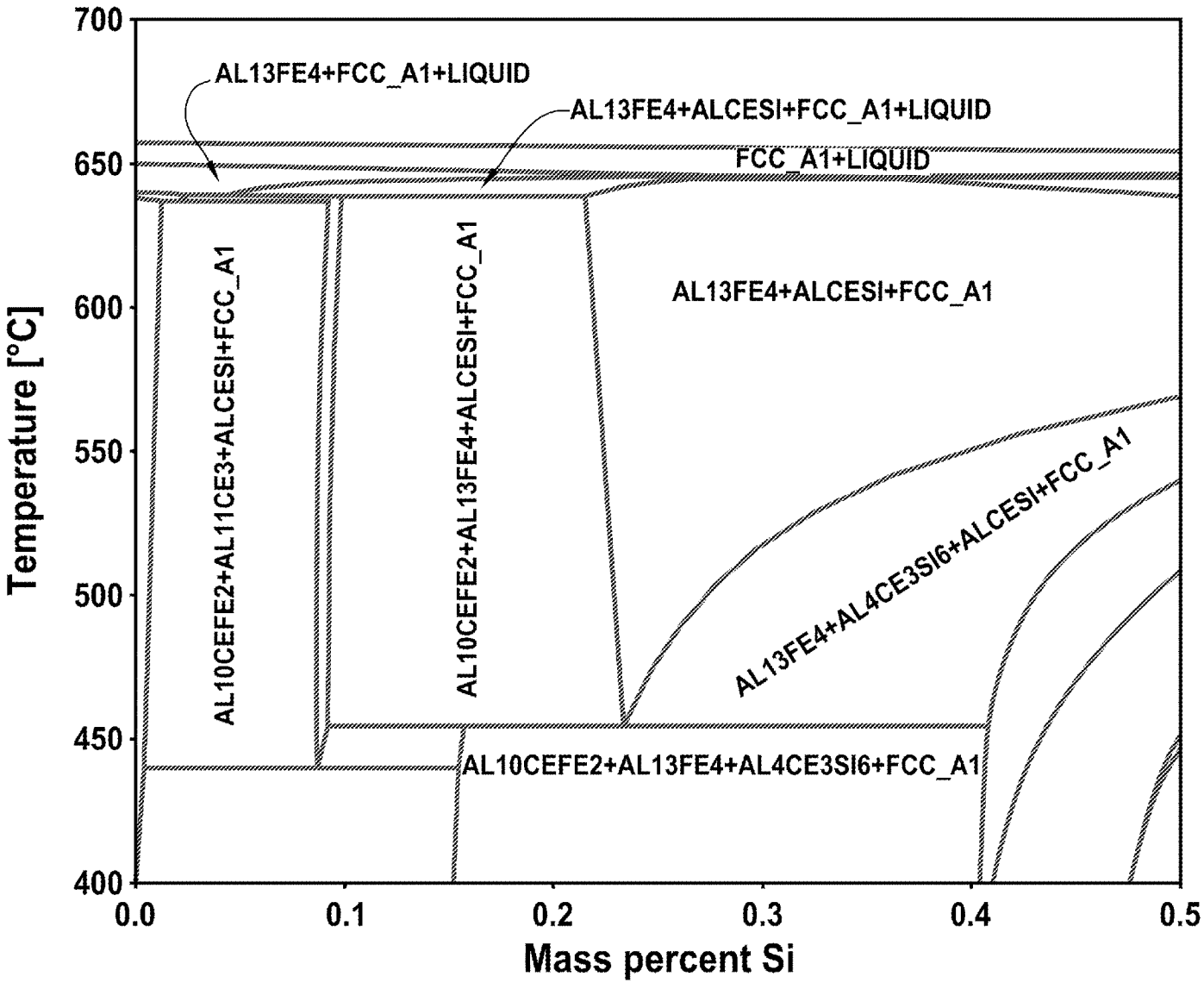
FIG. 1A. Calculated Al—Si pseudo-binary phase diagram with 0.5% Fe and 1% Ce.

The compositions, methods, and systems described herein may be understood more readily by reference to the following detailed description of specific aspects of the disclosed subject matter and the Examples included therein.

Before the present compositions, methods, and systems are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

In this specification and in the claims that follow, reference will be made to a number of terms, which shall be defined to have the following meanings.

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "an agent" includes mixtures of two or more such agents, reference to "the component" includes mixtures of two or more such components, and the like.

"Optional" or "optionally" means that the subsequently described event or circumstance can or cannot occur, and that the description includes instances where the event or circumstance occurs and instances where it does not.

Ranges can be expressed herein as from "about" one particular value, and/or to "about" another particular value. By "about" is meant within 5% of the value, e.g., within 4, 3, 2, or 1% of the value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

It is understood that throughout this specification the identifiers "first" and "second" are used solely to aid in distinguishing the various components and steps of the disclosed subject matter. The identifiers "first" and "second" are not intended to imply any particular order, amount, preference, or importance to the components or steps modified by these terms.

References in the specification and concluding claims to parts by weight of a particular element or component in a composition denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent (wt. %) of a component, unless specifically stated to the contrary, is based on the total weight of the formulation or composition in which the component is included.

"Phase," as used herein, generally refers to a region of a material having a substantially uniform composition which is a distinct and physically separate portion of a heterogeneous system. The term "phase" does not imply that the material making up a phase is a chemically pure substance, but merely that the chemical and/or physical properties of the material making up the phase are essentially uniform throughout the material, and that these chemical and/or physical properties differ significantly from the chemical and/or physical properties of another phase within the material. Examples of physical properties include density, thickness, aspect ratio, specific surface area, porosity, and dimensionality. Examples of chemical properties include chemical composition.

Disclosed herein are aluminum alloys comprising from 0.3 to 1.5 wt % Fe; from 0.2 to 16 wt % Ce; from 0 to 2% Si; and the balance comprising Al and optionally additional components; wherein the ratio of Ce to Fe is 1.2 or more.

The aluminum alloy can, for example, comprise 0.3 wt % Fe or more (e.g., 0.35 wt % or more, 0.4 wt % or more, 0.45 wt % or more, 0.5 wt % or more, 0.55 wt % or more, 0.6 wt % or more, 0.65 wt % or more, 0.7 wt % or more, 0.75 wt % or more, 0.8 wt % or more, 0.85 wt % or more, 0.9 wt % or more, 0.95 wt % or more, 1 wt % or more, 1.05 wt % or more, 1.1 wt % or more, 1.15 wt % or more, 1.2 wt % or more, 1.25 wt % or more, 1.3 wt % or more, 1.35 wt % or more, 1.4 wt % or more, or 1.45 wt % or more). In some examples, the aluminum alloy can comprise 1.5 wt % or less Fe (e.g., 1.45 wt % or less, 1.4 wt % or less, 1.35 wt % or less, 1.3 wt % or less, 1.25 wt % or less, 1.2 wt % or less, 1.15 wt % or less, 1.1 wt % or less, 1.05 wt % or less, 1 wt % or less, 0.95 wt % or less, 0.9 wt % or less, 0.85 wt % or less, 0.8 wt % or less, 0.75 wt % or less, 0.7 wt % or less, 0.65 wt % or less, 0.6 wt % or less, 0.55 wt % or less, 0.5 wt % or less, 0.45 wt % or less, 0.4 wt % or less, or 0.35 wt % or less). The amount of Fe in the aluminum alloy can range from any of the minimum values described above to any of the maximum values described above. For example, the aluminum alloy can comprise from 0.3 to 1.5 wt % Fe (e.g., from 0.3 wt % to 0.9 wt %, from 0.9 wt % to 1.5 wt %, from 0.3 wt % to 0.6 wt %, from 0.6 wt % to 0.9 wt %, from 0.9 wt % to 1.2 wt %, from 1.2 wt % to 1.5 wt %, from 0.3 wt % to 1.4 wt %, from 0.4 wt % to 1.5 wt %, from 0.4 wt % to 1.4 wt %, from 0.3 wt % to 1.2 wt %, from 0.3 wt % to 0.1 wt %, or from 0.4 wt % to 0.6 wt %). In some examples, the aluminum alloy comprises 0.5 wt % Fe.

The aluminum alloy can, for example, comprise 0.2 wt % Ce or more (e.g., 0.25 wt % or more, 0.3 wt % or more, 0.35 wt % or more, 0.4 wt % or more, 0.45 wt % or more, 0.5 wt % or more, 0.55 wt % or more, 0.6 wt % or more, 0.65 wt % or more, 0.7 wt % or more, 0.75 wt % or more, 0.8 wt % or more, 0.85 wt % or more, 0.9 wt % or more, 0.95 wt % or more, 1 wt % or more, 1.1 wt % or more, 1.2 wt % or more, 1.3 wt % or more, 1.4 wt % or more, 1.5 wt % or more, 1.6 wt % or more, 1.7 wt % or more, 1.8 wt % or more, 1.9 wt % or more, 2 wt % or more, 2.1 wt % or more, 2.2 wt % or more, 2.3 wt % or more, 2.4 wt % or more, 2.5 wt % or more, 2.6 wt % or more, 2.7 wt % or more, 2.8 wt % or more, 2.9 wt % or more, 3 wt % or more, 3.25 wt % or more, 3.5 wt % or more, 3.75 wt % or more, 4 wt % or more, 4.25 wt % or more, 4.5 wt % or more, 4.75 wt % or more, 5 wt % or more, 5.5 wt % or more, 6 wt % or more, 6.5 wt % or more, 7 wt % or more, 7.5 wt % or more, 8 wt % or more, 8.5 wt % or more, 9 wt % or more, 9.5 wt % or more, 10 wt % or more, 11 wt % or more, 12 wt % or more, 13 wt % or more, 14 wt % or more, or 15 wt % or more). In some examples, the aluminum alloy can comprise 16 wt % Ce or less (e.g., 15 wt % or less, 14 wt % or less, 13 wt % or less, 12 wt % or less, 11 wt % or less, 10 wt % or less, 9.5 wt % or less, 9 wt % or less, 8.5 wt % or less, 8 wt % or less, 7.5 wt % or less, 7 wt % or less, 6.5 wt % or less, 6 wt % or less, 5.5 wt % or less, 5 wt % or less, 4.75 wt % or less, 4.5 wt % or less, 4.25 wt % or less, 4 wt % or less, 3.75 wt % or less, 3.5 wt % or less, 3.25 wt % or less, 3 wt % or less, 2.9 wt % or less, 2.8 wt % or less, 2.7 wt % or less, 2.6 wt % or less, 2.5 wt % or less, 2.4 wt % or less, 2.3 wt % or less, 2.2 wt % or less, 2.1 wt % or less, 2 wt % or less, 1.9 wt % or less, 1.8 wt % or less, 1.7 wt % or less, 1.6 wt % or less, 1.5 wt % or less, 1.4 wt % or less, 1.3 wt % or less, 1.2 wt % or less, 1.1 wt % or less, 1 wt % or less, 0.95 wt % or less, 0.9 wt % or less, 0.85 wt % or less, 0.8 wt % or less, 0.75 wt % or less, 0.7 wt % or less, 0.65 wt % or less, 0.6 wt % or less, 0.55 wt % or less, 0.5 wt % or less, 0.45 wt % or less, 0.4 wt % or less, 0.35 wt % or less, 0.3 wt % or less, or 0.25 wt % or less). The amount of Ce in the aluminum alloy can range from any of the minimum values described above to any of the maximum values described above. For example, the aluminum alloy can comprise from 0.2 to 16 wt % Ce (e.g., from 0.2 wt % to 8 wt %, from 8 wt % to 6 wt %, from 0.2 wt % to 4 wt %, from 4 wt % to 8 wt %, from 8 wt % to 12 wt %, from 12 wt % to 16 wt %, from 0.3 wt % to 16 wt %, from 0.2 wt % to 15 wt %, from 0.3 wt % to 15 wt %, from 0.2 wt % to 4.5 wt %, from 4.5 wt % to 9 wt %, from 9 wt % to 16 wt %, from 0.2 wt % to 3 wt %, from 3 wt % to 6 wt %, from 6 wt % to 9 wt %, from 9 wt % to 12 wt %, from 12 wt % to 16 wt %, from 0.2 wt % to 8.5 wt %, from 0.3 wt % to 9 wt %, from 0.3 wt % to 8.5 wt %, from 0.2 wt % to 12 wt %, from 0.2 wt % to 9 wt %, from 0.2 wt % to 8 wt %, from 0.2 wt % to 6 wt %, from 0.2 wt % to 4 wt %, from 0.2 wt % to 2.5 wt %, from 0.2 wt % to 2 wt %, from 0.2 wt % to 1.5 wt %, or from 0.5 wt % to 1.5 wt %).

The aluminum alloy can, for example, comprise 0 wt % or more Si (e.g., 0.01 wt % or more, 0.05 wt % or more, 0.1 wt % or more, 0.15 wt % or more, 0.2 wt % or more, 0.25 wt % or more, 0.3 wt % or more, 0.35 wt % or more, 0.4 wt % or more, 0.45 wt % or more, 0.5 wt % or more, 0.55 wt % or more, 0.6 wt % or more, 0.65 wt % or more, 0.7 wt % or more, 0.75 wt % or more, 0.8 wt % or more, 0.85 wt % or more, 0.9 wt % or more, 0.95 wt % or more, 1 wt % or more, 1.1 wt % or more, 1.2 wt % or more, 1.3 wt % or more, 1.4 wt % or more, 1.5 wt % or more, 1.6 wt % or more, 1.7 wt % or more, 1.8 wt % or more, or 1.9 wt % or more). In some examples, the aluminum alloy can comprise 2 wt % Si or less (e.g., 1.9 wt % or less, 1.8 wt % or less, 1.7 wt % or less, 1.6 wt % or less, 1.5 wt % or less, 1.4 wt % or less, 1.3 wt % or less, 1.2 wt % or less, 1.1 wt % or less, 1 wt % or less, 0.95 wt % or less, 0.9 wt % or less, 0.85 wt % or less, 0.8 wt % or less, 0.75 wt % or less, 0.7 wt % or less, 0.65 wt % or less, 0.6 wt % or less, 0.55 wt % or less, 0.5 wt % or less, 0.45 wt % or less, 0.4 wt % or less, 0.35 wt % or less, 0.3 wt % or less, 0.25 wt % or less, 0.2 wt % or less, 0.15 wt % or less, 0.1 wt % or less, 0.05 wt % or less, or 0.01 wt % or less). The amount of Si in the aluminum alloy can range from any of the minimum values described above to any of the maximum values described above. For example, the aluminum alloy can comprise from 0 to 2% Si (e.g., from 0 wt % to 1 wt %, from 1 wt % to 2 wt %, from 0 wt % to 0.5 wt %, from 0.5 wt % to 1 wt %, from 1 wt % to 1.5 wt %, from 1.5 wt % to 2 wt %, from 0 wt % to 1.9 wt %, from 0.1 wt % to 2 wt %, from 0.1 wt % to 1.9 wt %, from 0 wt % to 1.8 wt %, or from 0 wt % to 1.5 wt %). In some examples, the aluminum alloy is substantially free of Si.

In some examples, the aluminum alloy comprises from 0.3 to 1.5 wt % Fe; from 0.2 to 9 wt % Ce; from 0 to 2% Si; and the balance comprising Al and optionally additional components. In some examples, the aluminum alloy comprises from 0.3 to 1 wt % Fe; from 0.2 to 9 wt % Ce; from 0 to 2% Si; and the balance comprising Al and optionally additional components. In some examples, the aluminum alloy comprises from 0.3 to 1.5 wt % Fe; from 0.2 to 2.5 wt % Ce; from 0 to 2% Si; and the balance comprising Al and optionally additional components. In some examples, the aluminum alloy comprises from 0.3 to 1.5 wt % Fe, from 0.2 to 9 wt % Ce; from 0 to 0.5% Si; and the balance comprising Al and optionally additional components. In some examples, the aluminum alloy comprises from 0.3 to 1.5 wt % Fe; from 0.2 to 1.5 wt % Ce; from 0 to 2% Si; and the balance comprising Al and optionally additional components.

In some examples, the aluminum alloy comprises from 0.3 to 1 wt % Fe; from 0.2 to 2.5 wt % Ce; from 0 to 2% Si; and the balance comprising Al and optionally additional components. In some examples, the aluminum alloy comprises from 0.3 to 1 wt % Fe; from 0.2 to 1.5 wt % Ce; from 0 to 2% Si; and the balance comprising Al and optionally additional components. In some examples, the aluminum alloy comprises from 0.3 to 1 wt % Fe; from 0.2 to 9 wt % Ce; from 0 to 0.5% Si; and the balance comprising Al and optionally additional components. In some examples, the aluminum alloy comprises from 0.3 to 1.5 wt % Fe; from 0.2 to 2.5 wt % Ce; from 0 to 0.5% Si; and the balance comprising Al and optionally additional components. In some examples, the aluminum alloy comprises from 0.3 to 1.5 wt % Fe; from 0.2 to 1.5 wt % Ce; from 0 to 0.5% Si; and the balance comprising Al and optionally additional components.

In some examples, the aluminum alloy comprises from 0.3 to 1 wt % Fe; from 0.2 to 2.5 wt % Ce; from 0 to 0.5% Si; and the balance comprising Al and optionally additional components. In some examples, the aluminum alloy comprises 0.3 to 1 wt % Fe, 0.2 to 1.5 wt % Ce, and 0 to 0.5 wt % Si, and the balance comprising Al and optionally additional components.

The aluminum alloy can, for example, have a ratio of Ce to Fe of 1.2 or more (e.g., 1.3 or more, 1.4 or more, 1.5 or more, 1.6 or more, 1.7 or more, 1.8 or more, 1.9 or more, 2 or more, 2.1 or more, 2.2 or more, 2.3 or more, 2.4 or more, 2.5 or more, 2.6 or more, 2.7 or more, 2.8 or more, 2.9 or more, 3 or more, 3.25 or more, 3.5 or more, 3.75 or more, 4 or more, 4.25 or more, 4.75 or more, 5 or more, 5.5 or more, 6 or more, 6.5 or more, 7 or more, 7.5 or more, 8 or more, 8.5 or more, 9 or more, 9.5 or more, 10 or more, 11 or more, 12 or more, 13 or more, or 14 or more). In some examples, the aluminum alloys can have a ratio of Ce to Fe of 15 or less (e.g., 14 or less, 13 or less, 12 or less, 11 or less, 10 or less, 9.5 or less, 9 or less, 8.5 or less, 8 or less, 7.5 or less, 7 or less, 6.5 or less, 6 or less, 5.5 or less, 5 or less, 4.75 or less, 4.5 or less, 4.25 or less, 4 or less, 3.75 or less, 3.5 or less, 3.25 or less, 3 or less, 2.9 or less, 2.8 or less, 2.7 or less, 2.6 or less, 2.5 or less, 2.4 or less, 2.3 or less, 2.2 or less, 2.1 or less, 2 or less, 1.9 or less, 1.8 or less, 1.7 or less, 1.6 or less, 1.5 or less, 1.4 or less, or 1.3 or less). The ratio of Ce to Fe in the aluminum alloy can range from any of the minimum values described above to any of the maximum values described above. For example, the aluminum alloy can have a ratio of Ce to Fe of from 1.2 to 15 (e.g., from 1.2 to 7, from 7 to 15, from 1.2 to 5, from 5 to 9, from 9 to 15, from 1.2 to 3, from 3 to 5, from 5 to 7, from 7 to 9, from 9 to 11, from 11 to 13, from 13 to 15, from 1.3 to 15, from 1.2 to 14, from 1.3 to 14, from 1.2 to 12, from 1.2 to 9, from 1.3 to 9, from 1.2 to 8.5, from 1.3 to 8.5, or from 1.2 to 8).

In some examples, the aluminum alloy can further comprise one or more additional components, such as Mn, Mg, Cu, Zn, or a combination thereof.

In some examples, the aluminum alloy can further comprise 0 wt % or more of one or more additional components (e.g., 0.1 wt % or more, 0.2 wt % or more, 0.3 wt % or more, 0.4 wt % or more, 0.5 wt % or more, 0.6 wt % or more, 0.7 wt % or more, 0.8 wt % or more, or 0.9 wt % or more). In some examples, the aluminum alloy can further comprise 1 wt % or less of one or more additional components (e.g., 0.9 wt % or less, 0.8 wt % or less, 0.7 wt % or less, 0.6 wt % or less, 0.5 wt % or less, 0.4 wt % or less, 0.3 wt % or less, 0.2 wt % or less, or 0.1 wt % or less). The amount of the one or more additional components in the aluminum alloy can range from any of the minimum values described above to any of the maximum values described above. For example, the aluminum alloy can further comprise from 0 to 1 wt % of one or more additional components (e.g., from 0 wt % to 0.5 wt %, from 0.5 wt % to 1 wt %, from 0 wt % to 0.2 wt %, from 0.2 wt % to 0.4 wt %, from 0.4 wt % to 0.6 wt %, from 0.6 wt % to 0.8 wt %, from 0.8 wt % to 1 wt %, from 0.1 wt % to 1 wt %, from 0 wt % to 0.9 wt %, or from 0.1 wt % to 0.9 wt %).

In some examples, the aluminum alloy can further comprise 0 wt % or more of Mn, Mg, Cu, Zn, or a combination thereof (e.g., 0.1 wt % or more, 0.2 wt % or more, 0.3 wt % or more, 0.4 wt % or more, 0.5 wt % or more, 0.6 wt % or more, 0.7 wt % or more, 0.8 wt % or more, or 0.9 wt % or more). In some examples, the aluminum alloy can further comprise 1 wt % or less of Mn, Mg, Cu, Zn, or a combination thereof (e.g., 0.9 wt % or less, 0.8 wt % or less, 0.7 wt % or less, 0.6 wt % or less, 0.5 wt % or less, 0.4 wt % or less, 0.3 wt % or less, 0.2 wt % or less, or 0.1 wt % or less). The amount of Mn, Mg, Cu, Zn, or a combination thereof in the aluminum alloy can range from any of the minimum values described above to any of the maximum values described above. For example, the aluminum alloy can further comprise from 0 to 1 wt % of Mn, Mg, Cu, Zn, or a combination thereof (e.g., from 0 wt % to 0.5 wt %, from 0.5 wt % to 1 wt %, from 0 wt % to 0.2 wt %, from 0.2 wt % to 0.4 wt %, from 0.4 wt % to 0.6 wt %, from 0.6 wt % to 0.8 wt %, from 0.8 wt % to 1 wt %, from 0.1 wt % to 1 wt %, from 0 wt % to 0.9 wt %, or from 0.1 wt % to 0.9 wt %).

For example, the aluminum alloy can comprise from 0.3 to 1.5 wt % Fe; from 0.2 to 16 wt % Ce; from 0 to 2% Si; from 0 to 1 wt % Mn; from 0 to 1 wt % Mg; from 0 to 1 wt % Cu; from 0 to 1 wt % Zn; and the balance comprising Al. In some examples, the aluminum alloy can comprise from 0.3 to 1.5 wt % Fe; from 0.2 to 9 wt % Ce; from 0 to 2% Si; from 0 to 1 wt % Mn; from 0 to 1 wt % Mg; from 0 to 1 wt % Cu; from 0 to 1 wt % Zn; and the balance comprising Al.

In some examples, the aluminum alloy comprises a ternary Al—Ce—Fe phase. In some examples, the aluminum alloy comprises a $Al_{10}FeCe_2$ phase. In some examples, the aluminum alloy comprises a $Al_{10}FeCe_2$ phase, which can reduce or neutralize the detrimental effect of Fe on a mechanical property (e.g., yield strength, tensile strength, elongation at failure, etc.) of the aluminum alloy.

In some examples, the ratio of Ce to Fe being 1.2 or more suppresses formation of a $Al_{13}Fe_4$ phase. In some examples, the ratio of Ce to Fe being 1.2 or more suppresses formation of $\theta$-$Al_{13}Fe_4$ phase. In some examples, the aluminum alloy is substantially free of a $Al_{13}Fe_4$ phase.

In some examples, the AlCeSi phase is substantially absent from the aluminum alloy.

In some examples, the aluminum alloy has an improved mechanical property (e.g., yield strength, tensile strength, elongation at failure, etc.) relative to a corresponding aluminum alloy in the absence of Ce, with a Ce/Fe ratio less than 1.2, with greater than 2 wt % Si, or a combination thereof.

In some examples, the aluminum alloy has a yield strength of 55 MPa or more (e.g., 60 MPa or more, 65 MPa or more, 70 MPa or more, 75 MPa or more, 80 MPa or more, 85 MPa or more, 90 MPa or more, 95 MPa or more, 100 MPa or more, 105 MPa or more, 110 MPa or more, or 115 MPa or more). In some examples, the aluminum alloy can have a yield strength of 120 MPa or less (e.g., 115 MPa or less, 110 MPa or less, 105 MPa or less, 100 MPa or less, 95 MPa or less, 90 MPa or less, 85 MPa or less, 80 MPa or less, 75 MPa or less, 70 MPa or less, 65 MPa or less, or 60 MPa or less). The yield strength of the aluminum alloy can range from any of the minimum values described above to any of the maximum values described above. For example, the aluminum alloy can have a yield strength of from 55 MPa to 120 MPa (e.g., from 55 MPa to 90 MPa, from 90 MPa to 120 MPa, from 55 MPa to 70 MPa, from 70 MPa to 85 MPa, from 85 MPa to 100 MPa, from 100 MPa to 120 MPa, from 60 MPa to 120 MPa, from 55 MPa to 115 MPa, or from 60 MPa to 115 MPa). The yield strength can be selected in view of a variety of factors, such as, for example, based on the intended application. For example, in case of an automotive structural casting which is a load bearing component and required to have limited deflection, the yield strength of the aluminum alloy can be selected to be from 110 to 120 MPa. Yield strength can be determined using the offset method. In this method, a straight line with a slope equal to alloys elastic modulus is drawn at a offset of 0.2% strain and its intersection with stress-strain curve is the yield strength.

In some examples, the aluminum alloy has an ultimate tensile strength of 175 MPa or more (e.g., 180 MPa or more, 185 MPa or more, 190 MPa or more, 195 MPa or more, 200 MPa or more, 205 MPa or more, 210 MPa or more, 215 MPa or more, 220 MPa or more, 225 MPa or more, 230 MPa or more, 235 MPa or more, 240 MPa or more, or 245 MPa or more). In some examples, the aluminum alloy has an ultimate tensile strength of 250 MPa or less (e.g., 245 MPa or less, 240 MPa or less, 235 MPa or less, 230 MPa or less, 225 MPa or less, 220 MPa or less, 215 MPa or less, 210 MPa or less, 205 MPa or less, 200 MPa or less, 195 MPa or less, 190 MPa or less, 185 MPa or less, or 180 MPa or less). The ultimate tensile strength of the aluminum alloy can range from any of the minimum values described above to any of the maximum values described above. For example, the aluminum alloy can have an ultimate tensile strength of from 175 MPa to 250 MPa (e.g., from 175 MPa to 215 MPa, from 215 MPa to 250 MPa, from 175 MPa to 200 MPa, from 200 MPa to 225 MPa, from 225 MPa to 250 MPa, from 180 MPa to 250 MPa, from 175 MPa to 245 MPa, or from 180 MPa to 245 MPa). The ultimate tensile strength is the point on the stress-strain curve that separates the strain hardening region and the necking region. It is the highest stress point on a stress-strain curve. The ultimate tensile strength of the aluminum alloy can be selected in view of a variety of factors, for example based on the requirements of a specific application.

In some examples, the aluminum alloy has an elongation to failure of 4% or more (e.g., 5% or more, 6% or more, 7% or more, 8% or more, 9% or more, 10% or more, or 11% or more) In some examples, the aluminum alloy can have an elongation to failure of 12% or less (e.g., 11% or less, 10% or less, 9% or less, 8% or less, 7% or less, 6% or less, or 5% or less). The elongation to failure of the aluminum alloy can range from any of the minimum values described above to any of the maximum values described above. For example, the aluminum alloy can have an elongation to failure of rom 4% to 12% (e.g., from 4% to 8%, from 8% to 12%, from 4% to 6%, from 6% to 8%, from 8% to 10%, from 10% to 12%, from 5% to 12%, from 4% to 11%, or from 5% to 11%). The elongation to failure is the measure of alloy ductility and it indicates the amount of strain the material can accommodate before failure during tensile testing. The elongation to failure can be selected in view of a variety of factors, for example the intended application of the aluminum alloy.

Also disclosed herein are objects and/or articles of manufacture comprising any of the aluminum alloys described herein. Also disclosed herein are methods of use of any of the aluminum alloys, objects, and/or articles of manufacture described herein.

In some examples, the aluminum alloys described herein can offer high dimensional stability and good castability, which can make them suitable for high pressure die casting (HPDC) operations. In some examples, the aluminum alloys described herein can mitigate die soldering problems. HPDC is employed for high-volume and cost-efficient production of parts used in automotive (e.g., transmission cases, shock towers etc.), electronic industry (e.g., smartphone and laptop cases), and/or medical device components (e.g., manifold cover for ventilation machines). In some examples, the aluminum alloys described herein can be used for high-volume and cost-efficient production of parts used in automotive (e.g., transmission cases, shock towers etc.), electronic industry (e.g., smartphone and laptop cases), and/or medical device components (e.g., manifold cover for ventilation machines).

Also disclosed herein are method of making the aluminum alloys described herein. The methods can, for example, comprise heating a precursor aluminum alloy to a first temperature to melt the precursor aluminum alloy, thereby forming a molten precursor aluminum alloy; and adding Ce to the molten precursor aluminum alloy; thereby forming the aluminum alloy.

The term "precursor aluminum alloy" is used herein to refer to an aluminum alloy before it has undergone an addition of Ce as disclosed herein. It is not meant to imply that the precursor aluminum alloy is not yet an aluminum alloy (e.g., a metal element). In some examples, the precursor aluminum alloy comprises a secondary aluminum alloy (e.g., scrap or recycled aluminum alloy).

In some examples, the addition of Ce controls the formation of Al—Fe based intermetallic phases. In some examples, the addition of Ce neutralizes the detrimental effects of Fe on a mechanical property (e.g., yield strength, tensile strength, elongation at failure, etc.) of the aluminum alloy.

A number of embodiments of the invention have been described. Nevertheless, it will be understood that various modifications may be made without departing from the spirit and scope of the invention. Accordingly, other embodiments are within the scope of the following claims.

The examples below are intended to further illustrate certain aspects of the systems and methods described herein, and are not intended to limit the scope of the claims.

EXAMPLES

The following examples are set forth below to illustrate the methods and results according to the disclosed subject matter. These examples are not intended to be inclusive of all aspects of the subject matter disclosed herein, but rather to illustrate representative methods and results. These examples are not intended to exclude equivalents and variations of the present invention which are apparent to one skilled in the art.

Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of measurement conditions, e.g., component concentrations, temperatures, pressures and other measurement ranges and conditions that can be used to optimize the described process.

Example 1—Use of Cerium in Neutralizing Iron Impurity in Aluminum Alloys

Iron (Fe) is a major impurity element in primary and secondary (scrap) aluminum alloys, and is difficult to remove during melting and casting. Controlling the formation of Al—Fe based intermetallics via alloying is key to the mechanical properties of aluminum alloy products (Twarog et al. "High Integrity Casting of Lightweight Components", North American Die Casting Association, Arlington Heights, IL, USA, 2016; Schlesinger: Aluminum Recycling, 2nd edn., CRC Press, Boca Raton, F L, 2013).

Alloy Design

Ce additions of 0.2% to 1.5% to aluminum alloys containing up to 0.5% Si and up to 1% Fe impurity can form $Al_{10}FeCe_2$ phase (FIG. 1A and FIG. 1B), which can neutralize the detrimental effect of the high Fe content.

A Ce/Fe ratio of at least 1.2 is needed to suppress the formation of $\theta$-$Al_{13}Fe_4$ phase (FIG. 2), which is detrimental to the mechanical properties of the alloy.

Figure 3:
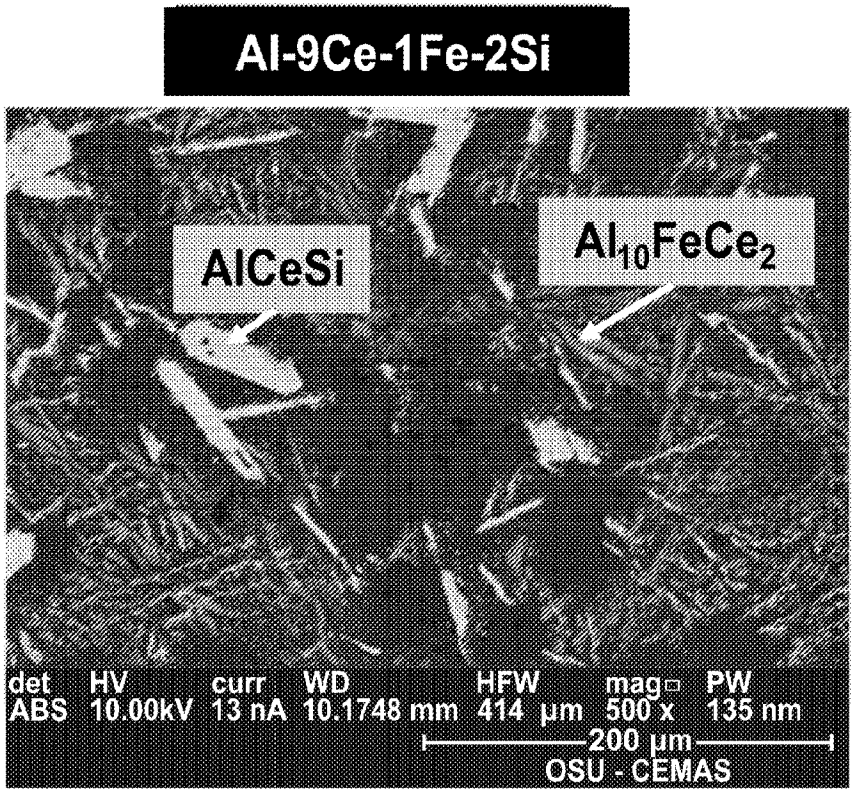
FIG. 3. Effect of Ce on Fe-containing intermetallics in Al-9Ce-1Fe and in Al-9Ce-1Fe-2Si alloys.
Figure 3:
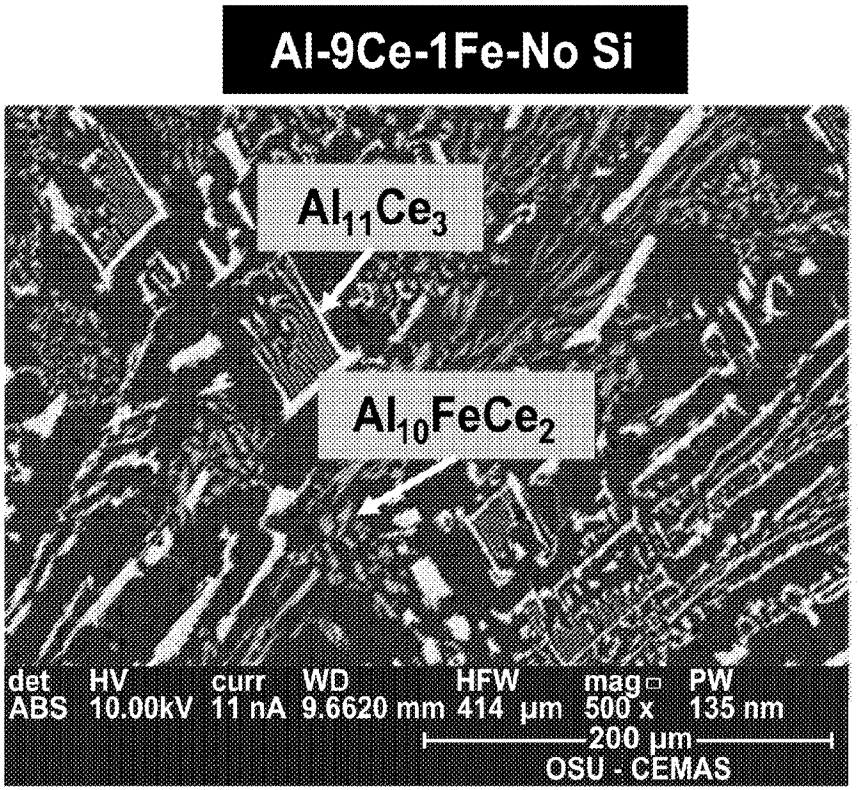

$Al_{10}FeCe_2$ phase will form in Al-(8-12%)Ce based alloys for high-temperature applications when Si is below 2% (FIG. 3). This suggests that these alloys can tolerate high Fe content (up to 1% for recycled alloys).

2% Si additions to Al-9% Ce alloys suppress the eutectic $Al_{11}Ce_3$ phase and replaces it with AlCeSi alloy (FIG. 4) and can reduce mechanical properties of the alloys (Table 1). Al—Ce based alloys should avoid high Si contents.

Alloy Synthesis

The alloys were prepared by melting a 99.5% commercially pure aluminum with a Al-10 wt. % Ce master alloy, a Al-10 wt. % Fe master alloy, and pure silicon in a graphite crucible using a vacuum induction melting furnace. The molten aluminum alloy was kept under vacuum for 30 minutes to ensure reduced H content and allow alloying elements to mix. Alloys were casted into different mediums (H13 steel permanent mold, sand cooling cups) to achieve different cooling rates. Molten aluminum alloy with Ce, Fe and Si additions were poured into molds at temperature range of 700-750° C.

Mechanical Properties

Table 1 shows 2% Si addition leads to formation of primary AlCeSi phase that reduces ductility of Al—Ce alloys.

Figure 6:
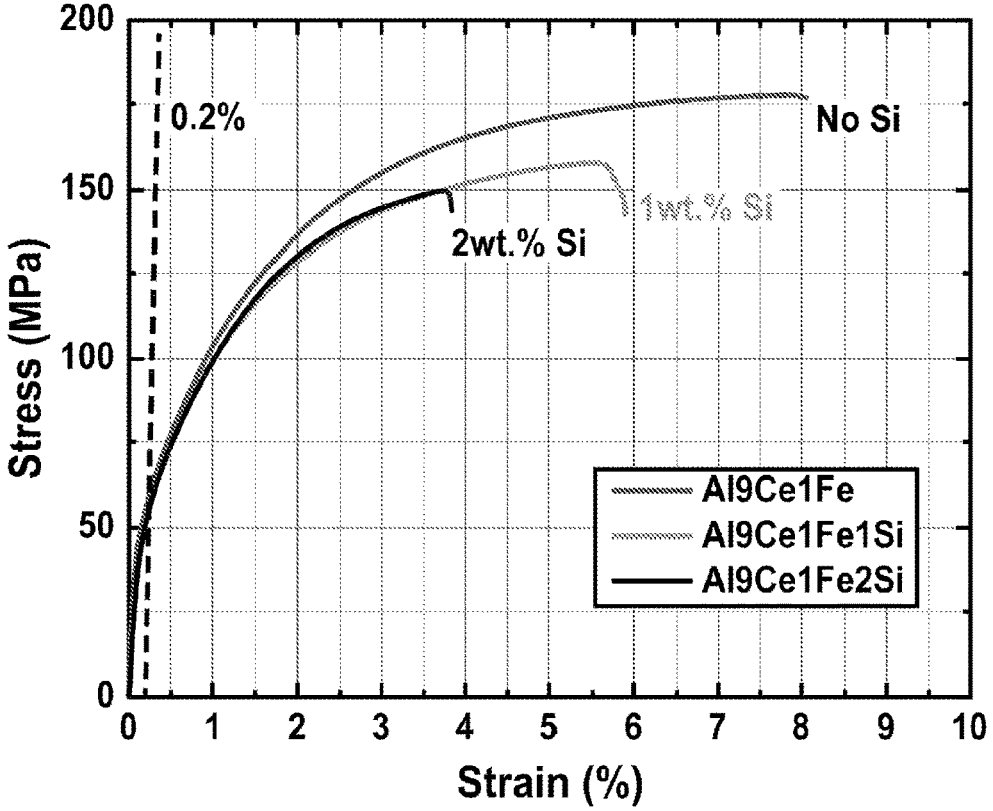
FIG. 6. Degradation of mechanical properties (especially alloy ductility) with increasing Si content in Al-9 wt. % Ce-1 wt. % Fe alloys. Gradual decrease in ductility with increasing Si content indicating detrimental effect of AlCeSi intermetallics on mechanical properties.
Figure 7:
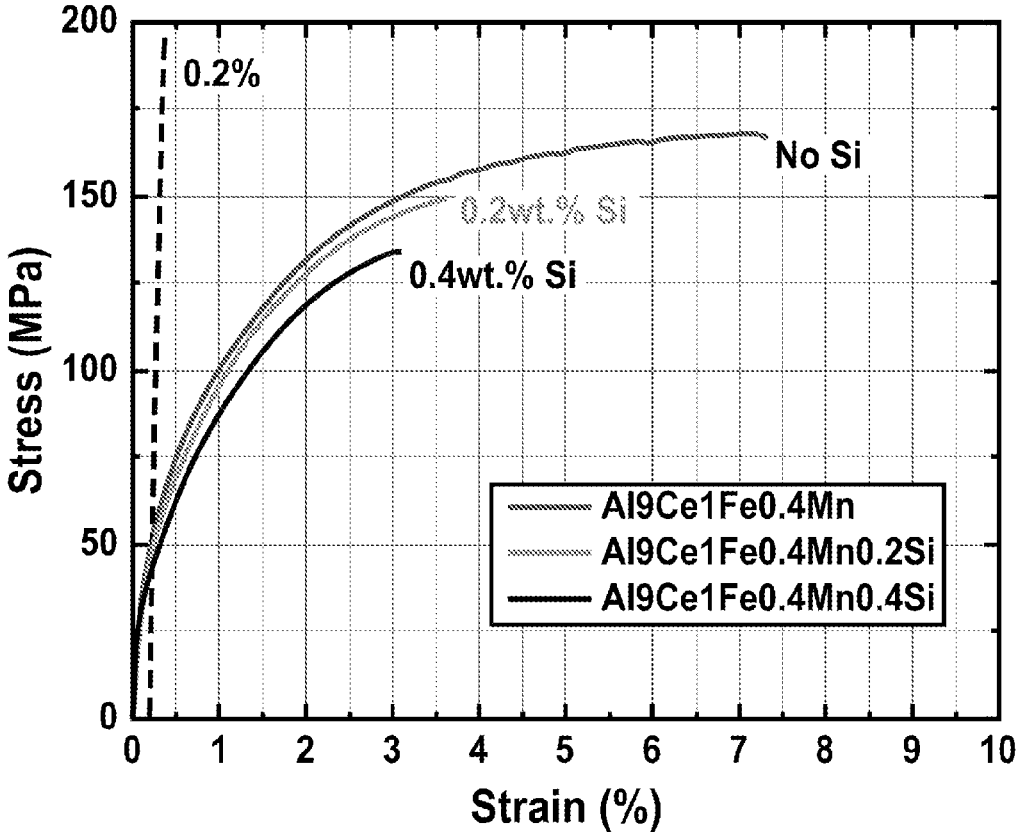
FIG. 7. Degradation of mechanical properties (especially alloy ductility) with increasing Si content in Al-9 wt. % Ce-1 wt. % Fe-0.4 wt. % Mn alloy systems. Gradual decrease in ductility with increasing Si content indicating detrimental effect of AlCeSi intermetallics on mechanical properties.

FIG. 6 and FIG. 7 illustrate the degradation of mechanical properties (especially alloy ductility) with increasing Si content in Al-9 wt. % Ce-1 wt. % Fe alloys (FIG. 6) and Al-9 wt. % Ce-1 wt. % Fe-0.4 wt. % Mn alloy systems (FIG. 7), respectively. Gradual decrease in ductility with increasing Si content indicating detrimental effect of AlCeSi intermetallics on mechanical properties.

TABLE 1

Mechanical properties of as-cast aluminum alloys

| Composition (wt. %) | Yield Strength (MPa) | Ultimate Tensile Strength (MPa) | Elongation (%) |
|---|---|---|---|
| Al—9Ce—1Fe (No Si) | 59 | 178 | 8.1 |
| Al—9Ce—1Fe—2Si | 55 | 149 | 3.8 |

Example 2

Although the world will need to increase primary production to keep up with demand, the following drivers are increasing adoption of both primary and secondary aluminum. Only 5% of the energy (and reduced emission) required to produce primary aluminum is needed to re-melt aluminum. Around 75% of the almost one billion metric tons of aluminum ever produced is still in productive use, some of it having been through countless recycle loops through its lifecycle (average lifetimes of about 15 to 20 years for vehicles and 40 to 50 years for buildings). In Europe and North America, scrap has been generated in sufficient quantities over the past 70 years to develop an economically strong and technically advanced secondary aluminum industry. Following the oil price shocks and energy cost increases of the 1970s, Japan ceased domestic primary aluminum production and switched to aluminum recycling in the 1980s. In addition to these traditional production centers, increasing recycling activities are evident in China, India, and Russia.

In about 2000, the United States secondary aluminum outpaced primary aluminum production (Kevin R. Anderson, "Technical Advancements in the Secondary Aluminum Industry", Light Metals Division Luncheon, TMS Annual Meeting, San Antonio, TX, Mar. 13, 2019). This was due to: increased adoption of secondary aluminum; and more primary aluminum being made and imported from Canada. Now 40% of the Al in North America is Secondary.

Figure 1B:
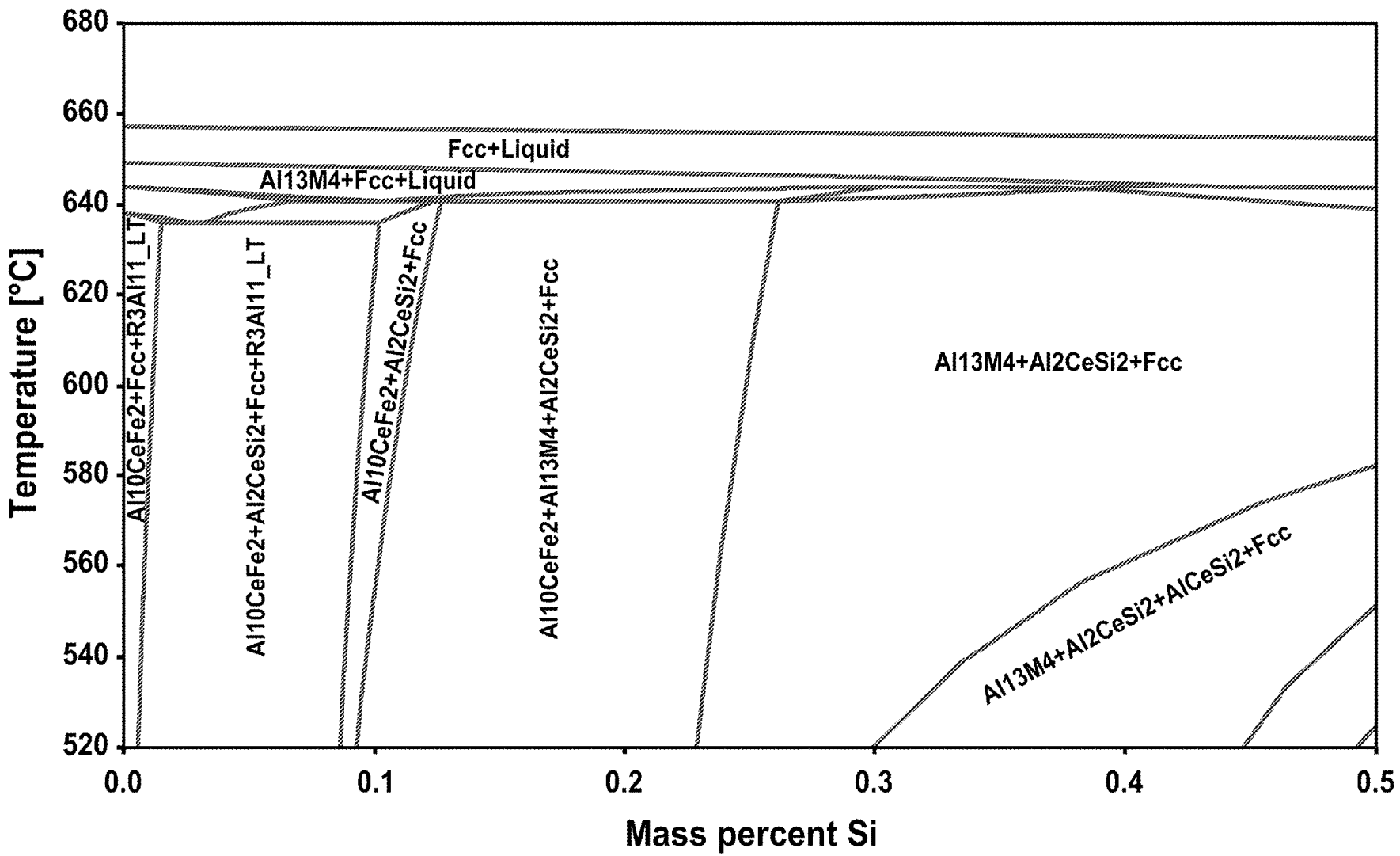
FIG. 1B. Calculated Al—Si pseudo-binary phase diagram with 0.5% Fe and 1% Ce.

CALPHAD modeling was used to calculate Al—Si pseudo-binary phase diagram with 0.5% Fe and 1% Ce at equilibrium cooling (FIG. 1A and FIG. 1B). Ce additions of 0.2% to 1.5% to aluminum alloys containing up to 0.5% Si and up to 1% Fe impurity can form $Al_{10}FeCe_2$ phase (FIG. 1A and FIG. 1B), which can neutralize the detrimental effect of the high Fe content.

Figure 2:
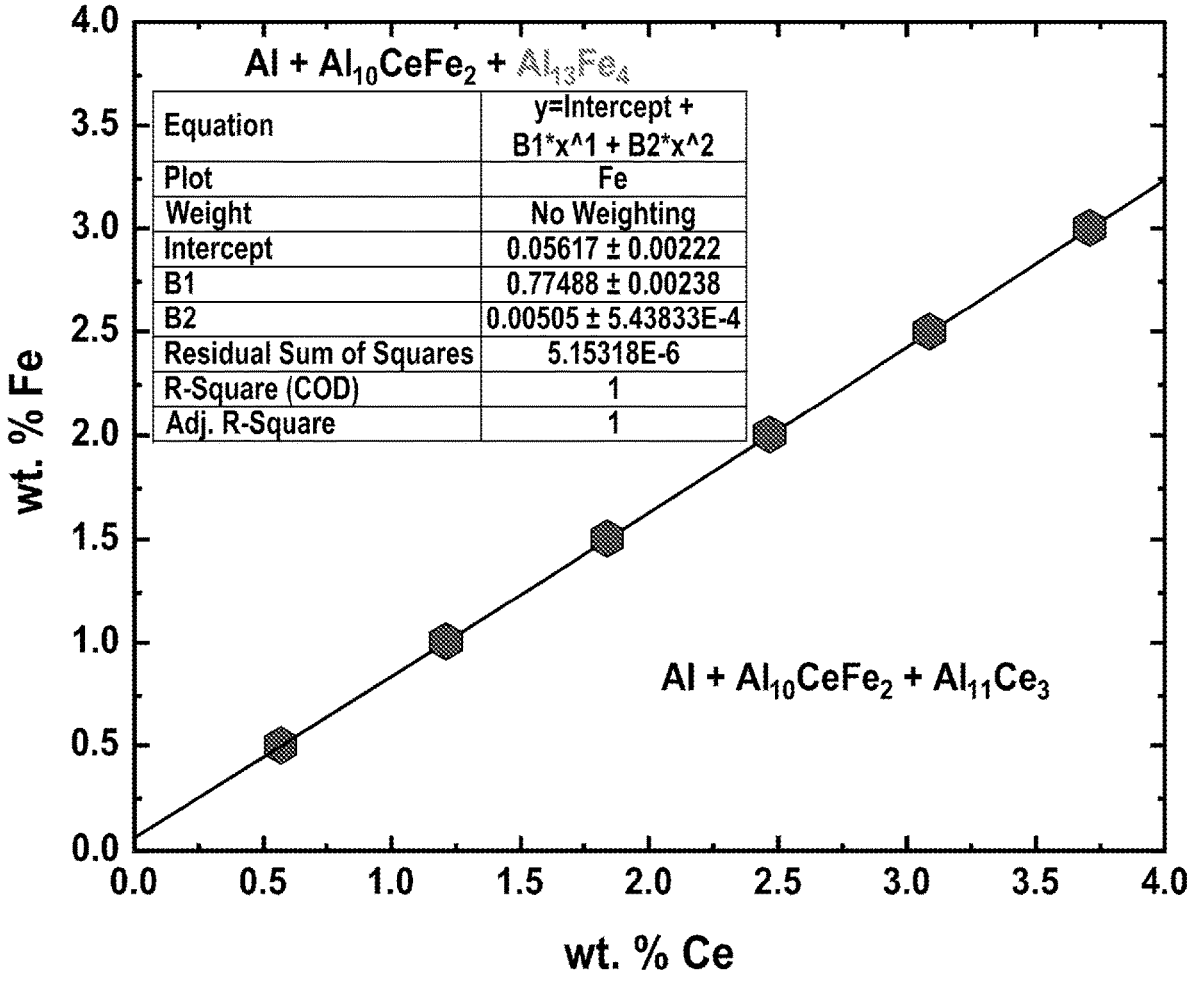
FIG. 2. Effect of Ce alloying on Fe-containing intermetallic phases in aluminum alloys.

CALPHAD modeling further indicated that a Ce/Fe ratio of at least 1.2 is needed to suppress the formation of $\theta$-$Al_{13}Fe_4$ phase, which is detrimental to the mechanical properties of mechanical properties (FIG. 2).

$Al_{10}FeCe_2$ phase will form in Al-(8-12%)Ce based alloys for high-temperature applications when Si is below 2% (FIG. 3). This suggests that these alloys can tolerate high Fe content (up to 1%) for recycled alloys.

Figure 4:
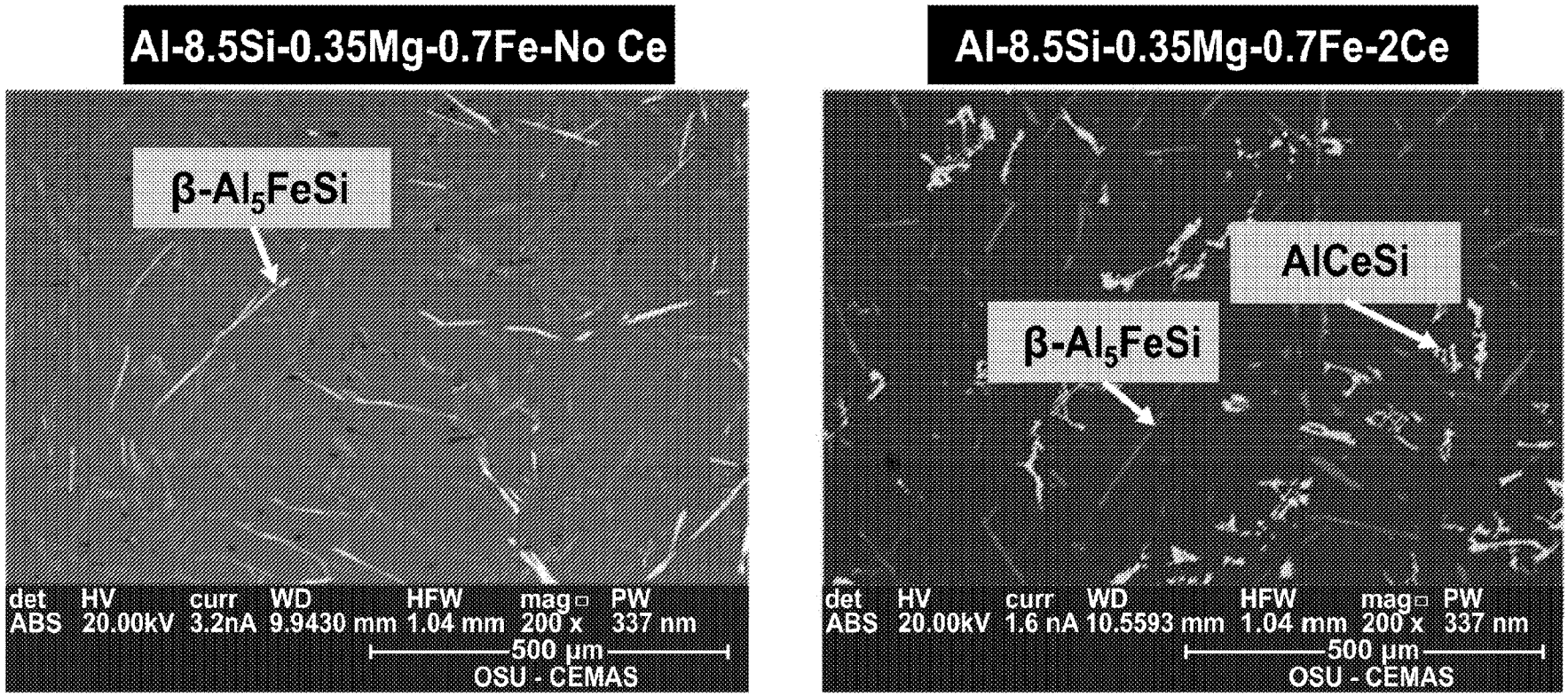
FIG. 4. Effect of Ce on Fe-containing intermetallics in Al-8.5Si-0.35Mg alloy.
Figure 5:
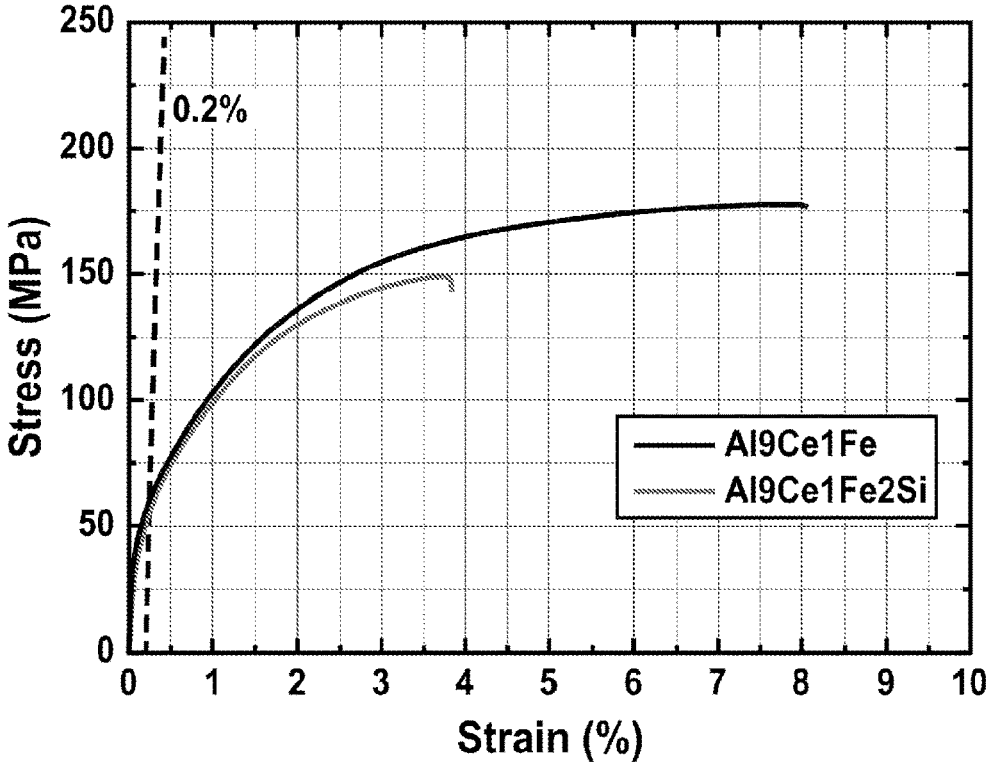
FIG. 5. Effect of Si on ductility of Al—Ce alloys.

Al—Ce based alloys (being developed for high-temperature applications) can potentially tolerate high Fe content (recycled alloys), due to the formation of $Al_{10}FeCe_2$ phase neutralizing the detrimental effect of the high Fe impurity content (up to 1%). 2% Si addition leads to formation of primary AlCeSi phase that reduces ductility of Al—Ce alloys (FIG. 3-FIG. 5; Table 1).

Al—Ce alloys offer high dimensional stability and good castability which makes them suitable for high pressure die casting (HPDC) operations and, when Al—Ce alloys are further alloyed with Fe, the die soldering problem can be mitigated. HPDC is employed for high-volume and cost-efficient production of parts used in automotive (transmission cases, shock towers etc.), electronic industry (smartphone and laptop cases), and/or medical device components (manifold cover for ventilation machines).

The aluminum alloys described herein can accommodate large contents of Fe thanks to formation of benign AlFeCe intermetallics instead of detrimental AlFe intermetallics for Ce range of 8-10 wt. %. Therefore, the aluminum alloys described herein are suitable for recycling of unsorted wrought aluminum scrap that may include high concentrations of Fe. The content of Si in this alloy system should be minimized (>0.5 wt. %) to avoid formation of AlFeSi and AlCeSi intermetallics that can reduce alloy ductility. Since Si content of wrought aluminum alloys are inherently low (>0.8 wt. %), recycled alloy can easily be diluted to achieve Si content below 0.5 wt. %. The refinement of AlFeCe intermetallics through rapid solidification can provide increase alloy strength without adversely affecting alloy ductility. Further strengthening can be achieved through solid solution strengthening from common wrought aluminum alloying elements, such as, Mg, Zn, Mn, and Cu etc.

Other advantages which are obvious and which are inherent to the invention will be evident to one skilled in the art. It will be understood that certain features and sub-combinations are of utility and may be employed without reference to other features and sub-combinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The methods of the appended claims are not limited in scope by the specific methods described herein, which are intended as illustrations of a few aspects of the claims and any methods that are functionally equivalent are intended to fall within the scope of the claims. Various modifications of the methods in addition to those shown and described herein are intended to fall within the scope of the appended claims. Further, while only certain representative method steps disclosed herein are specifically described, other combinations of the method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated.

What is claimed is:

1. An aluminum alloy comprising:
from 0.3 to 1.5 wt % Fe;
from 0.2 to 16 wt % Ce;
from 0 to 2% Si; and
the balance comprising Al and optionally additional components;
wherein the ratio of Ce to Fe is 1.2 or more;
wherein the ratio of Ce to Fe being 1.2 or more suppresses formation of a $Al_{13}Fe_4$ phase; and
wherein the aluminum alloy comprises a $Al_{10}FeCe_2$ phase, which neutralizes the detrimental effect of Fe on the mechanical properties of the aluminum alloy.

2. The aluminum alloy of claim 1, wherein the aluminum alloy is substantially free of a $Al_{13}Fe_4$ phase.

3. The aluminum alloy of claim 1, wherein the aluminum alloy comprises from 0.3 to 1 wt % Fe.

4. The aluminum alloy of claim 1, wherein the aluminum alloy comprises 0.2 to 9 wt % Ce.

5. The aluminum alloy of claim 1, wherein the aluminum alloy comprises from 0 to 0.5 wt % Si.

6. The aluminum alloy of claim 1, wherein the aluminum alloy is substantially free of Si.

7. The aluminum alloy of claim 1, wherein the aluminum alloy comprises from 0.3 to 1.5 wt % Fe; from 0.2 to 9 wt % Ce, from 0 to 2% Si; and the balance comprising Al and optionally additional components.

8. The aluminum alloy of claim 1, wherein the aluminum alloy comprises from 0.3 to 1 wt % Fe; from 0.2 to 2.5 wt % Ce; from 0 to 0.5% Si; and the balance comprising Al and optionally additional components.

9. The aluminum alloy of claim 1, wherein the aluminum alloy comprises 0.3 to 1 wt % Fe, 0.2 to 1.5 wt % Ce, and 0 to 0.5 wt % Si, and the balance comprising Al and optionally additional components.

10. The aluminum alloy of claim 1, wherein the AlCeSi phase is substantially absent from the aluminum alloy.

11. The aluminum alloy of claim 1, wherein the aluminum alloy further comprises Mn, Mg, Cu, Zn, or a combination thereof.

12. The aluminum alloy of claim 1, wherein the aluminum alloy further comprises from 0 to 1 wt % of one or more additional components.

13. The aluminum alloy of claim 1, wherein the aluminum alloy comprises from 0.3 to 1.5 wt % Fe; from 0.2 to 16 wt % Ce; from 0 to 2% Si; from 0 to 1 wt % Mn; from 0 to 1 wt % Mg; from 0 to 1 wt % Cu; from 0 to 1 wt % Zn; and the balance comprising Al.

14. The aluminum alloy of claim 1, wherein the aluminum alloy comprises from 0.3 to 1.5 wt % Fe; from 0.2 to 9 wt % Ce; from 0 to 2% Si; from 0 to 1 wt % Mn; from 0 to 1 wt % Mg; from 0 to 1 wt % Cu; from 0 to 1 wt % Zn; and the balance comprising Al.

15. The aluminum alloy of claim 1, wherein the aluminum alloy has:
a yield strength of from 55 MPa to 120 MPa;
an ultimate tensile strength of from 175 MPa to 250 MPa;
an elongation to failure of from 4% to 12%;
or a combination thereof.

16. An object or article of manufacture comprising the aluminum alloy of claim 1.

17. A method of making the aluminum alloy of claim 1, the method comprising:
heating a precursor aluminum alloy to a first temperature to melt the precursor aluminum alloy, thereby forming a molten precursor aluminum alloy; and
adding Ce to the molten precursor aluminum alloy;
thereby forming the aluminum alloy.

* * * * *